US005137004A

United States Patent [19]

Takahata et al.

[11] Patent Number: 5,137,004

[45] Date of Patent: Aug. 11, 1992

[54] TROUBLE DIAGNOSIS DEVICE FOR EGR SYSTEM

[75] Inventors: Toshio Takahata, Aikawa; Osamu Matsuno, Yokohama, both of Japan

[73] Assignee: Nissan Motor Co., Ltd., Yokohama, Japan

[21] Appl. No.: 750,864

[22] Filed: Aug. 28, 1991

[30] Foreign Application Priority Data

Aug. 28, 1990 [JP] Japan ..... 2-89925[U]
Sep. 5, 1990 [JP] Japan ..... 2-235371

[51] Int. Cl.[5] ..... F02M 25/07
[52] U.S. Cl. ..... 123/571
[58] Field of Search ..... 123/568, 569, 571; 364/431.06

[56] References Cited

U.S. PATENT DOCUMENTS 4,671,107 6/1987 Chiesa et al. ..... 123/571
4,715,348 12/1987 Kobayashi et al. ..... 123/571
4,762,109 8/1988 Jeenicke ..... 123/571
4,770,146 9/1988 Shibata et al. ..... 123/571
4,825,841 5/1989 Norota et al. ..... 123/571

FOREIGN PATENT DOCUMENTS 0027922 3/1977 Japan ..... 123/571
62-51746 3/1987 Japan .
0051747 3/1987 Japan ..... 123/571
0159757 7/1987 Japan ..... 123/571
0170747 7/1989 Japan ..... 123/571

*Primary Examiner*—Willis R. Wolfe
*Attorney, Agent, or Firm*—Foley & Lardner

[57] ABSTRACT

A trouble diagnosis device for an exhaust gas recirculation system in an automotive vehicle. The trouble diagnosis device which basically accomplishes a trouble diagnosis in accordance with a pressure difference between an intake pressure during execution of exhaust gas recirculation and an intake pressure during stopping of the exhaust gas recirculation. The trouble diagnosis device is comprised of a throttle valve opening degree sensor to produce an output representative of an opening degree of a throttle valve. The trouble diagnosis device is further comprised of a microcomputer which functions to sample the output of the throttle valve opening degree sensor at predetermined operation cycles of the microcomputer. Then moving averages of the sampled values are given, upon which a fluctuation amount of the moving averages is detected. The trouble diagnosis is stopped in response to the fluctuation amount larger than a predetermined value.

14 Claims, 9 Drawing Sheets

FIG. 3A
FIG. 3B
FIG. 3C
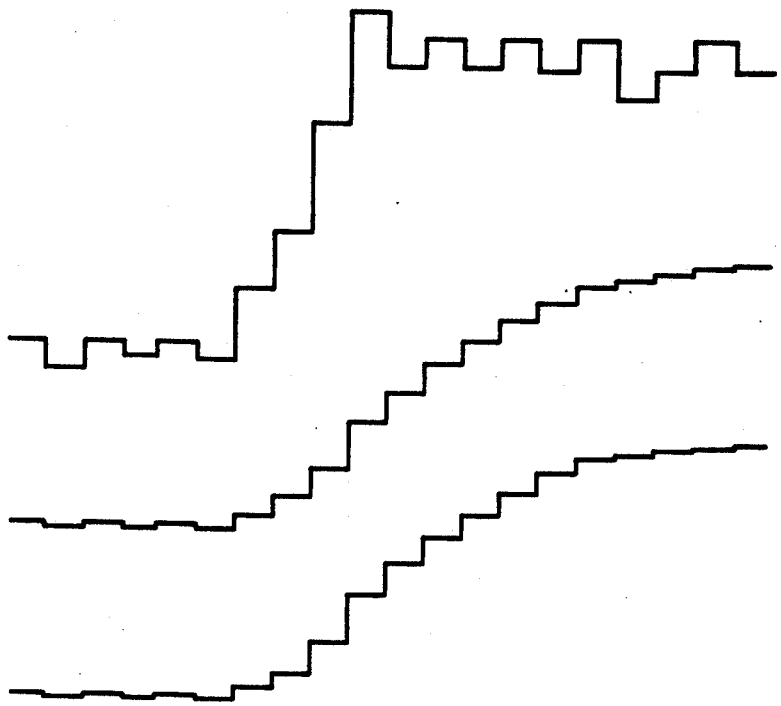
FIG. 4
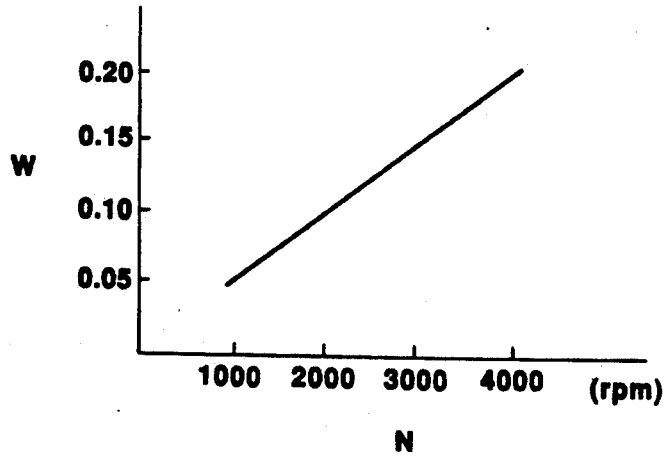

TROUBLE DIAGNOSIS DEVICE FOR EGR SYSTEM

BACKGROUND OF THE INVENTION

1. Field of the Invention

This invention relates to improvements in a trouble diagnosis device for diagnosing as to whether an exhaust gas recirculation system is normally operating or not in accordance with a pressure difference between an intake pressure during execution of exhaust gas recirculation and an intake pressure during stopping of exhaust gas recirculation.

2. Description of the Prior Art

Most automotive vehicles are equipped with an EGR (exhaust gas recirculation) system in which a part of exhaust gas of an engine is fed back through an EGR passage to an intake air passageway to accomplish an emission control of NOx from the engine. If trouble arises in the EGR system, it is a matter of course that the emission control cannot be normally carried out. Additionally, such trouble is usually difficult to be noticed by a driver, and therefore there is the possibility that the vehicle is driven for a long period of time with a troubled condition of the EGR system.

In view of the above, a trouble diagnosis device for the EGR system has been proposed as disclosed, for example, in Japanese Patent Provisional Publication No. 62-51746. With this trouble diagnosis device, first a deviation in engine speed per a predetermined time and a deviation in throttle valve opening degree per a predetermined time are measured in an EGR operating range in which the exhaust gas recirculation is carried out. Subsequently, a judgement is made as to whether each deviation is below a predetermined value or not. In case of being below the predetermined value, the engine operation is judged to be within a steady state operating condition. In this steady state operating condition, an EGR control valve is temporarily closed to stop the exhaust gas recirculation. Thus, intake pressures Pon, Poff are detected respectively when the EGR control valve is opened and closed. If a pressure difference $\Delta P$ ($=Pon-Poff$) is out of a predetermined range, it is judged that a malfunction exists in the exhaust gas recirculation system.

However, difficulties have been encountered in the above discussed trouble diagnosis device, in which there is the possibility of sharply lowering a frequency or chances of carrying out the trouble diagnosis by the above method in which the judgement is first made as to whether the engine operation is within the steady state operating condition or not upon directly detecting the fluctuation in engine speed or throttle valve opening degree. In order to achieve the trouble diagnosis, it is also necessary that the engine operation is within the EGR operating range. More specifically, for example, in a case that the throttle valve opening degree has instantaneously changed and returned to an original value, a judgement is made such that the engine operation is not within the steady state operating condition if the throttle valve opening degree change exceeds a predetermined value, though the intake pressure in an intake air passageway hardly changes under the effect of response retardation in pressure in an air intake system. In such a case, trouble diagnosis for the EGR system cannot be carried out, thereby unnecessarily lowering the frequency of the trouble diagnosis.

Further difficulties may be encountered in the above discussed trouble diagnosis device, in which it is difficult to make a precise judgement upon merely comparing the pressure difference $\Delta P$ with the predetermined range. More specifically, if the intake pressure Pon in the intake air passageway has changed owing to the variation in throttle valve opening degree even when the exhaust gas recirculation is normally carried out, it has been known that the pressure difference $\Delta P$ also changes with the intake pressure change. Accordingly, in case that the above-mentioned predetermined range is a fixed range defined by fixed values, there is the possibility of judging as an occurrence of trouble in the EGR system a response to any special engine operating condition even if the exhaust gas recirculation is being normally carried out. Additionally, the pressure difference $\Delta P$ becomes smaller than that in the condition where the exhaust gas recirculation is normally carried out, in a case when the EGR control valve is not normally operated or in a case when the EGR passage is clogged. In contrast, the pressure difference $\Delta P$ becomes larger in a case that an orifice disposed in the EGR passage is accidentally taken off. In such a case, it is impossible to detect the occurrence of trouble in the EGR system. Furthermore, if an exhaust gas recirculation rate is out of a predetermined range, it cannot be possible to make a such a precise trouble diagnosis for judging an occurrence of trouble.

SUMMARY OF THE INVENTION

It is an object of the present invention to provide an improved trouble diagnosis device for an exhaust gas recirculation system, which can overcome drawbacks encountered in conventional trouble diagnosis devices.

Another object of the present invention is to provide an improved trouble diagnosis device for an exhaust gas recirculation system, which has a high accuracy of trouble diagnosis for the exhaust gas recirculation system.

A further object of the present invention is to provide an improved trouble diagnosis device for an exhaust gas recirculation system, which has a high frequency of trouble diagnosis for the exhaust gas recirculation system.

The trouble diagnosis device of the present invention is for an exhaust gas recirculation system including an EGR passage through which a part of exhaust gas is fed to an intake air passageway of an engine downstream of a throttle valve, and means by which the EGR passage is closable to stop a flow of exhaust gas therethrough and openable to allow exhaust gas to flow therethrough. The trouble diagnosis device is comprised of first means for detecting an intake pressure within the intake air passageway. A second means is provided to detect a difference between the intake pressure in a first time in which the EGR passage is opened and the intake pressure in a second time in which the EGR passage is closed. A trouble diagnosis is accomplished in accordance with the difference. Accordingly, the exhaust gas recirculation is compulsorily temporarily stopped in an engine operating range in which the exhaust gas recirculation is carried out, upon which the intake pressures before and during the stopping of the exhaust gas recirculation are detected to obtain the pressure difference. A malfunction is judged to arise in the EGR system in accordance with the pressure difference. Additionally, a third means is provided to raise an accuracy of the trouble diagnosis in the EGR system in accordance with an engine operating parameter.

A preferable aspect of the third means includes means for detecting a throttle valve opening degree of the throttle valve to produce an output representative of the throttle valve opening degree; means for sampling the output of the throttle valve opening degree detecting means with lapse of time to obtain sampled values; means for providing moving averages of the sampled values to obtain averaged values; and means for detecting a fluctuation amount of the averaged values in a time during an execution of the trouble diagnosis, in which the trouble diagnosis is stopped in accordance with the fluctuation amount.

By virtue of this third means, the output representative of the throttle valve opening degree is periodically sampled. Then, the moving averages of the sampled values are obtained to detect the fluctuation amount of the averaged values. The trouble diagnosis in the EGR system is stopped in accordance with the fluctuation amount, thus largely increasing the frequency or changes of the trouble diagnosis thereby raising the accuracy of trouble diagnosis.

Another preferable aspect of the above-mentioned third means includes means for correcting the pressure difference in accordance with the intake pressure in the first time to obtain a corrected pressure difference; and means for judging an occurrence of trouble in the exhaust gas reciculation system in accordance with the corrected pressure difference.

By virture of this third means, the pressure difference is corrected by the intake pressure during the execution of the exhaust gas recirculation. The occurrence of trouble in the exhaust gas recirculation system is judged in accordance with the corrected pressure difference, thereby achieving a more precise trouble diagnosis in the exhaust gas recirculation system.

BRIEF DESCRIPTION OF THE DRAWINGS

In the drawings, like reference numerals designate like elements and parts throughout figures, in which:

FIGS. 3A to 3C are time charts showing sampling values and weighted means values used in the operation in the flowchart of FIG. 2 in comparison with intake pressure in an intake manifold;

FIG. 4 is a graph showing the relationship between engine speed N and the weighted means value W, employed in the operation in the flowchart of FIG. 2;

DETAILED DESCRIPTION OF THE INVENTION

Figure 1:
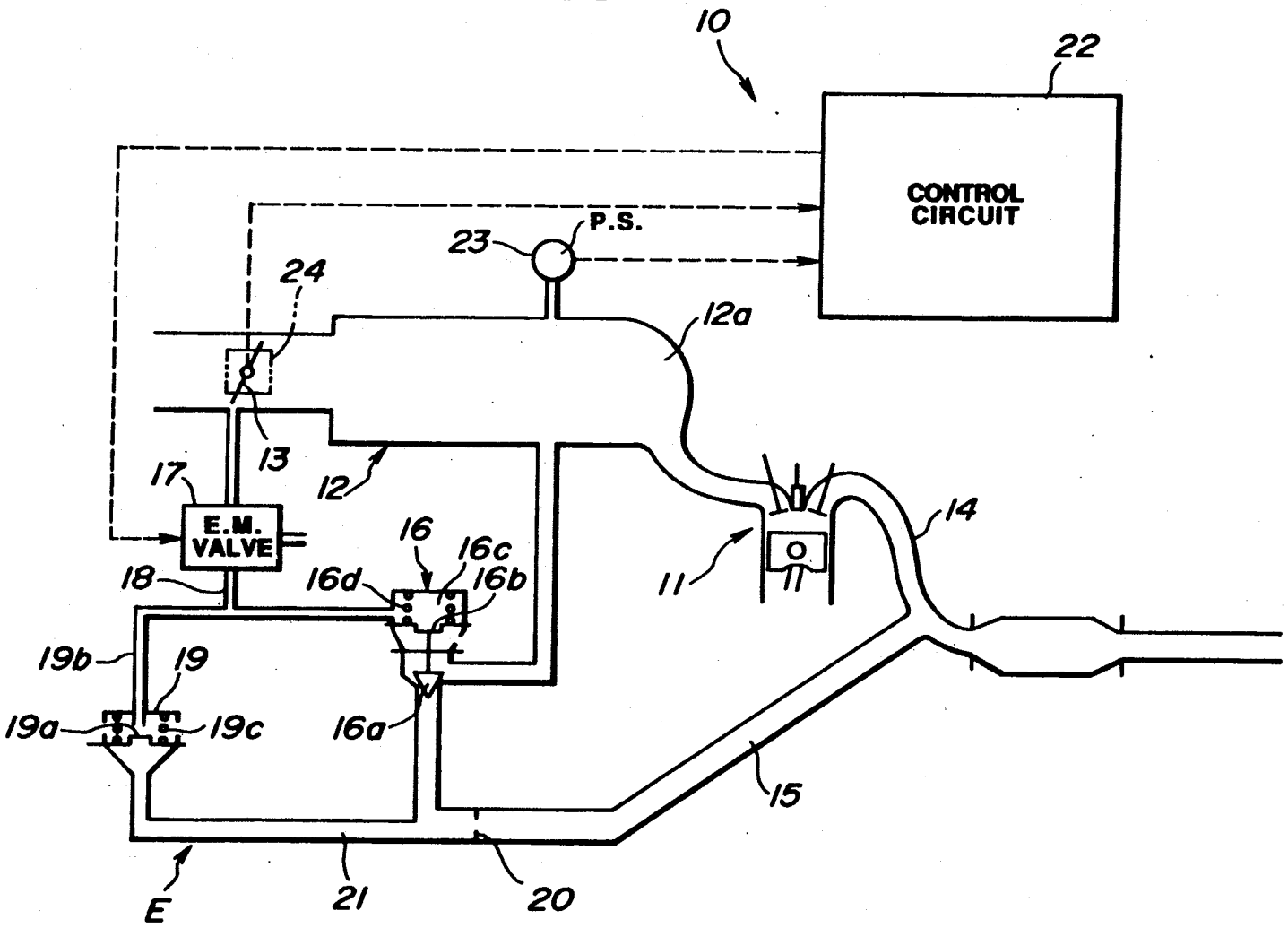
FIG. 1 is a schematic illustration of an embodiment of a trouble diagnosis device in accordance with the present invention.

Referring now to FIG. 1, an embodiment of a trouble diagnosis device for an EGR (exhaust gas recirculation) system E is represented by the reference numeral 10. In this embodiment, the EGR system E is of a so-called BPT (back pressure transducer) type and for an internal combustion engine 11 mounted on an automotive vehicle (not shown). The engine 11 is provided with an intake manifold 12*a* forming part of an intake air passageway 12 through which intake air is supplied to the engine 11. The intake manifold 12*a* is located downstream of a throttle valve 13. The engine 11 is further provided with an exhaust gas passageway 15 through which exhaust gas is discharged out of the engine 11.

An EGR (exhaust gas recirculation) passage 15 forming part of the EGR system E is provided to connect the exhaust gas passageway 14 and the intake manifold 12*a* so that a part of exhaust gas can be introduced into the intake manifold 12*a*. An EGR (exhaust gas recirculation) control valve 16 is disposed in the EGR passage 15 to control the flow of exhaust gas in the EGR passage 15. The EGR control valve 16 includes a valve member 16*a* by which the EGR passage 15 is closable. The valve member 16*a* is connected to a diaphragm member 16*b* defining a vacuum chamber 16*c*. A spring 16*d* is disposed in the vacuum chamber 16*c* to bias the valve member 16*a* in a direction to close the EGR passage 15. The vacuum chamber 16*c* is communicable through a vacuum passage 18 with the intake air passageway 12 at a location near the throttle valve 13 so that intake vacuum prevailing at the location near the throttle valve 13 is supplied through the vacuum passage 18 to the vacuum chamber 16*c* of the EGR control valve 16.

An electromagnetic valve 17 is disposed in the vacuum passage 18 and adapted to be deenergized or turned OFF to open and thereby to allow the intake vacuum in the intake air passageway 12 to be supplied to the vacuum chamber 16*c* of the EGR control valve 16. Electromagnetic valve 17 is adapted to be energized or turned ON to close and thereby to allow atmospheric air to be supplied to the vacuum chamber 16*c*. Additionally, an orifice 20 is formed in the EGR passage 15 upstream of the EGR valve 16. A passage 21 is branched off from the EGR passage 15 between the orifice 20 and the EGR valve 16 and provided at its free end with a BPT (back pressure transducer) valve 19 which is adapted to control the atmospheric air to be supplied to the vacuum chamber 16*c* of the EGR control valve 16 in accordance with the pressure of exhaust gas prevailing in the passage 21. More specifically, the BPT valve 19 includes a valve member 19*a* which is movable in accordance with the exhaust gas pressure. The valve member 19*a* is contactable to the open end of a pipe 19*b* to close the pipe 19*b*. The pipe 19*b* is connected to the vacuum passage 18 at a location between the EGR valve 16 and the electromagnetic valve 17. A spring 19c is disposed to bias the valve member 19a to separate from the pipe 19b. The pipe 19b is supplied with atmospheric air when the valve member 19a separates from the open end of the pipe 19b under a condition in which the pressure of exhaust gas prevailing in the passage 21 lowers below a predetermined or preset value.

With the above-discussed EGR system E, when the exhaust gas recirculation is required to be carried out, the elecromagnetic valve 17 is deenergized so that the vacuum chamber 16c of the EGR valve 16 is supplied with the intake vacuum. This moves the valve member 16a upwardly in FIG. 1 to allow exhaust gas to flow from the exhaust gas passageway 14 to the intake manifold 12a. At this time, if the exhaust gas pressure in the passage 21 lowers below the preset value, the valve member 19a of the BPT valve 19 separate from the pipe 19b thereby to allow atmospheric air to be introduced into the vacuum passage 18. Consequently, the EGR control valve 16 is closed to stop the flow of exhaust gas through the EGR passage 15 thereby stopping the exhaust gas recirculation. It will be understood that what is meant by the "exhaust gas recirculation" is a flow of exhaust gas from the exhaust gas passageway 14 through the EGR passage 15 to the intake air passageway 12. However, when the exhaust gas pressure in the passage 21 again rises to a level not lower than the preset value, the valve member 19a of the BPT valve 19 closes the open end of the pipe 19b thereby to allow the intake vacuum in the intake air passageway 12 to be supplied to the vacuum chamber 16c of the EGR control valve 16. Consequently, the EGR control valve 16 is opened to allow the exhaust gas to flow through the EGR passage 15, thus again carrying out the exhaust gas recirculation. Such an operation is repeated to control an exhaust gas recirculation (EGR) rate generally at a predetermined value. The exhaust recirculation rate is a volume ratio of the exhaust gas recirculated to the intake air passageway 12, relative to intake air flowing through the intake air passageway 12. Additionally, when the exhaust gas recirculation is required to be stopped, for example, during an idling operation or a time in which the engine has not yet warmed up, the electromagnetic valve 17 is energized to allow atmospheric air to be introduced into the vacuum passage 18, thereby closing the EGR valve. As a result, the exhaust gas is prevented from flowing through the EGR passage 15.

An engine control circuit (microcomputer) 22 is provided to control engine operations such as a fuel injection control in accordance with engine operating conditions, and to control the electromagnetic valve 17 to be energized or deenergized in accordance with engine operating conditions such as the temperature of engine coolant, engine load and the like thereby accomplishing the control of the EGR system 10. It will be understood that the engine 11 is provided with at least one fuel injector (not shown) for injecting fuel into the intake air passageway 12, in which the injection timing and the injected amount of fuel are controlled by the control circuit 22. Additionally, the control circuit 22 is adapted to accomplish the trouble diagnosis for the EGR system 10 as discussed in detail below. In this regard, the control circuit 22 may form part of the trouble diagnosis device 10 for the EGR system E.

The trouble diagnosis device 10 includes a pressure sensor 23 adapted to detect the intake vacuum prevailing in the intake manifold 12a. A throttle position sensor 24 is provided to detect the position or opening degree of the throttle valve 13. The throttle position sensor 24 includes, for example, a potentiometer. The outputs of the pressure sensor 23 and the throttle position sensor 24 are supplied to the control circuit 22. The output of the throttle position sensor 24 is subjected to an A/D (analog to digital) conversion in a predetermined computer computation cycle of the control circuit 22, thereby providing a sampling value TVOi. A moving average of the sampling value TVOi is obtained, for example, by a weighted mean calculation represented by the following equation (1):

$$ATVOi = W \cdot TVOi + (1 - W) \cdot ATVOi - 1 \quad (1)$$

where W is a weighting factor set within a range of $0 < W < 1$; ATVOi is a current weighted mean value; and ATVOi−1 is the weighted mean value at a prior time, such as the immediately preceding computer computation cycle.

For example, when the sampling value TVOi is one shown in FIG. 3A, the weighted mean value ATVOi of the sampling value becomes as shown in FIG. 3B. It will be seen that the weighted mean value ATVOi varies similarly to an intake vacuum prevailing in the intake manifold 12a which vacuum is shown in FIG. 3C. The weighting factor W is approximately set to be proportional to engine speed N of the engine 11 as shown in FIG. 4. This depends on the fact that, under a condition where the above-mentioned intake vacuum in the intake manifold 12a is relatively high, a time constant $\tau$ in pressure response is a function of engine speed N of the engine 11 as represented by the following formula:

$$\tau \propto \frac{V_M}{V_C \cdot N} \quad (2)$$

where $V_M$ is the volume of the intake air passageway 12 downstream of the throttle valve 13; and $V_C$ is the displacement of the engine.

Figure 2:
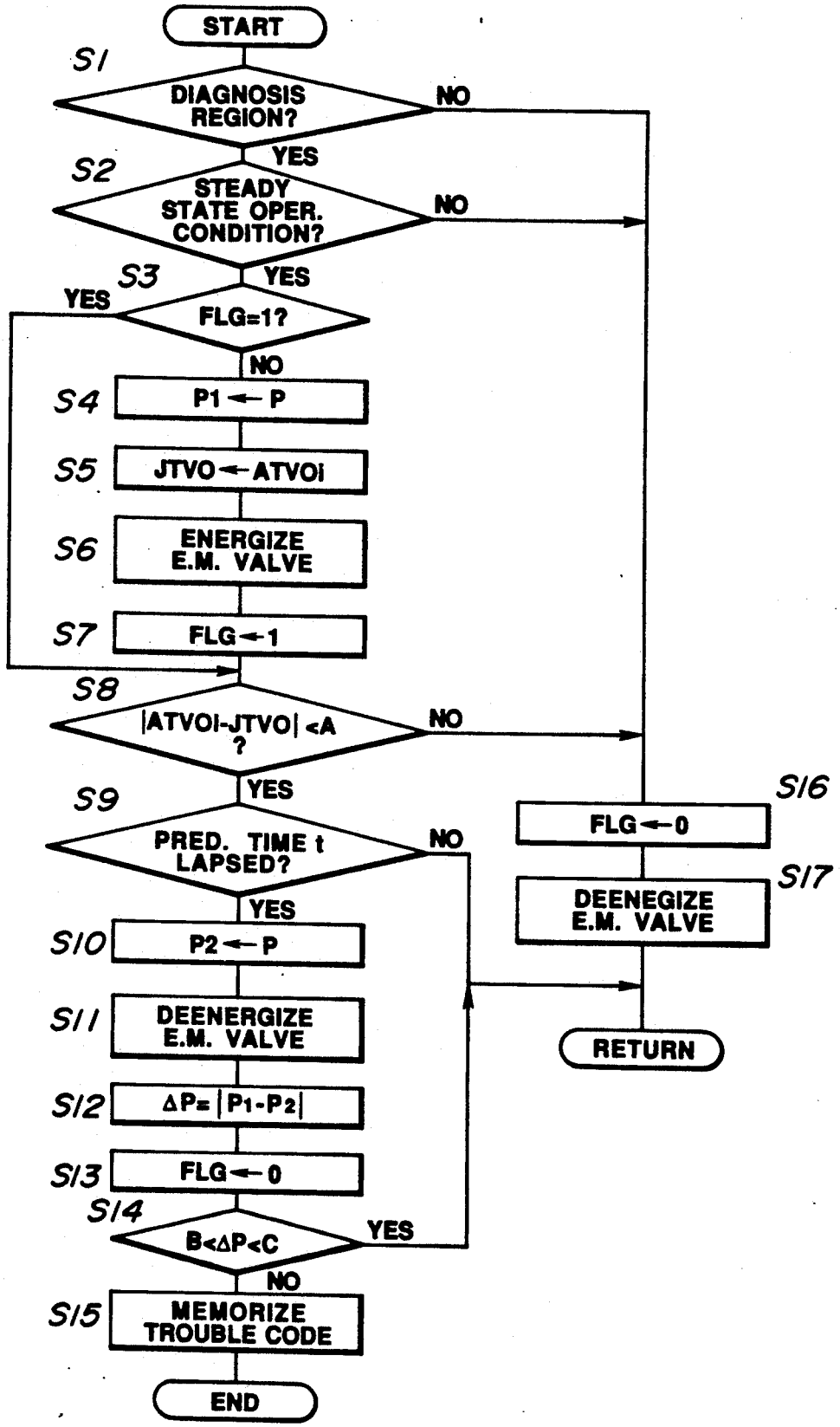
FIG. 2 is a flowchart of operation of the trouble diagnosis device of FIG. 1.

Next, the manner of operation of the trouble diagnosis device 10 of this embodiment will be discussed with reference to the flowchart in FIG. 2. The operation or flow of the flowchart is carried out in a predetermined computer computation cycle of the microcomputer 22 together with the engine operation control such as the fuel injection control.

First, at a step S1, a judgement is made as to whether the engine operation is within a diagnosis region or not. The diagnosis region is, for example, previously set to be securely within an EGR system operation range in which the exhaust gas recirculation is carried out. The setting of the diagnosis region is made depending upon the engine speed N and a basic fuel injection amount which is determined in accordance with the engine speed N and the amount of intake air. The diagnosis region is stored in the form of a map data in the control circuit 22.

When the engine operation is out of the diagnosis region, the flow goes to steps S16 and S17 discussed after and then the control returns to other engine operating controls. When the engine operation is within the diagnosis region, a judgement is made as to whether the engine operation is within a steady state operating condition by detecting whether a fluctuation or variation amount of the engine speed N within a predetermined time is within a predetermined range or not, at a step S2. When the judgement is made such that the engine operation is not in the steady state engine operating condition in which the engine speed fluctuation amount is out of the predetermined range, the flow goes to the steps S16 and S17, and thereafter the control returns to other engine operating controls. When the judgement is made such that the engine operation is within the steady state engine operating condition in which the engine speed fluctuation amount is within the predetermined range, a further judgement is made as to whether a flag FLG discussed after is "1" or not, at a step S3.

In case that the flag FLG is "1", the flow goes to a step S8 discussed after. In case that the flag FLG is "0", the output of the pressure sensor 23 is taken in the control circuit 22, in which the intake vacuum P within the intake manifold 23 is set as an intake manifold P1 at the exhaust gas recirculation, at a step S4.

Subsequently, the weighted mean value ATVOi of the throttle valve opening degree obtained as discussed before is set as a throttle valve opening degree JTVO at a time immediately before the stopping of the exhaust gas recirculation. Then, the electromagnetic valve 17 is energized to close the EGR control valve 16 thereby stopping the exhaust gas recirculation, at a step S6. A flag FLG is made "1" representing that the exhaust gas recirculation is stopping, at a step S7.

Next, the weighted mean value ATVOi is compared with the throttle valve opening degree JTVO to judge whether the difference |ATVOi−JTVO| between them is lower than a predetermined value A or not, at the step S8. When the difference is not lower than the predetermined value A, it is judged that the intake vacuum in the intake air passageway 12 has been changed to such an extent as to affect the trouble disgnosis of the EGR system E, under the effect of large fluctuation of throttle valve opening degree. Therefore, the trouble diagnosis is stopped. In other words, after the flag FLG is reset at "0", the electromagnetic valve 17 is deenergized thereby reopening the exhaust gas recirculation, at the steps S16 and S17. After the operations of the steps S16 and S17, the control returns to other engine operating controls.

When the difference |ATVOi−JTVO| is lower than the predetermined value A, a judgement is made as to whether a predetermined time t has lapsed or not after the electromagnetic valve 17 is energized, at a step S9. If the predetermined time t has not lapsed, the control returns to other engine operating controls, and thereafter the operations at the steps S1 to S3 are again executed. In case of "YES" at the steps S1 to S3, the flow of executing the operation of the step S8 after the operation of the step 3 is repeated, in which a detection is made as to whether the difference |ATVOi−JTVO| is greater than the predetermined value A or not within the predetermined time t. In case that the difference |ATVOi−JTVO| is greater than the predetermined value A within the predetermined time t, the trouble diagnosis is stopped as discussed above.

When the difference |ATVOi−JTVO| does not vary over the predetermined value A and the predetermined time t has lapsed under the steady state operating condition of the engine, the intake vacuum P within the intake manifold 12 is set as an intake vacuum P2 in a time in which the exhaust gas recirculation is stopped, and thereafter the electromagnetic valve 17 is deenergized thereby reopening the exhaust gas recirculation, at steps S10 and S11.

Subsequently, a pressure differential ΔP,(=|P1−P2|) between the intake vacuum P1 during a time of exhaust gas recirculation and the intake vacuum P2 during a time when exhaust gas recirculation is stopped is calculated at a step 12. Then, the flag FLG is reset at "0" at a step S13.

Next, a judgement is made as to whether the above pressure differential ΔP is higher than a predetermined value B and lower than a predetermined level C or not, at a step S14. When the pressure differential ΔP is within the range of B<ΔP<C, a judgement is made such that the operation of the EGR system E is "normal", and then the control returns to other engine operating controls. When the pressure differential ΔP is out of the range, a judgement is made such that the operation of the EGR system E is "abnormal", and then a trouble code representing a trouble arising in the EGR system is memorized at a step S15. Thus, a trouble diagnosis operation is completed.

As discussed above, in this embodiment, the judgement of the trouble of the EGR system is made when the pressure differential between the intake vacuum P1 during a time of exhaust gas recirculation and the intake vacuum P2 during a time when exhaust gas recirculation is stopped is out of the predetermined range upon stopping the exhaust gas recirculation for the predetermined time t under the engine operations within the diagnosis region and within the steady state operating condition. Additionally, during stopping of the exhaust gas recirculation, the output of the throttle valve position sensor 24 is cyclically sampled, and the sampling values ATVOi are successively subjected to the weighted mean calculation. When the thus obtained weighted mean value ATVOi varies over the predetermined value, the trouble diagnosis operation is stopped. In this connection, in a conventional technique in which a trouble diagnosis of an EGR control system is carried out upon directly detecting a throttle valve opening degree, there is the possibility of stopping the trouble diagnosis though an intake vacuum in an intake air passageway does not vary (owing to a throttle valve opening degree fluctuation) to such an extent as to affect the trouble diagnosis of the EGR control system. However, according to this embodiment of the present invention, by virtue of obtaining the weighted mean value, it is possible to stop the trouble diagnosis only when the throttle valve opening degree varies to such an extent as to affect the trouble diagnosis, thus increasing the chances or frequency of the trouble diagnosis.

Figure 5:
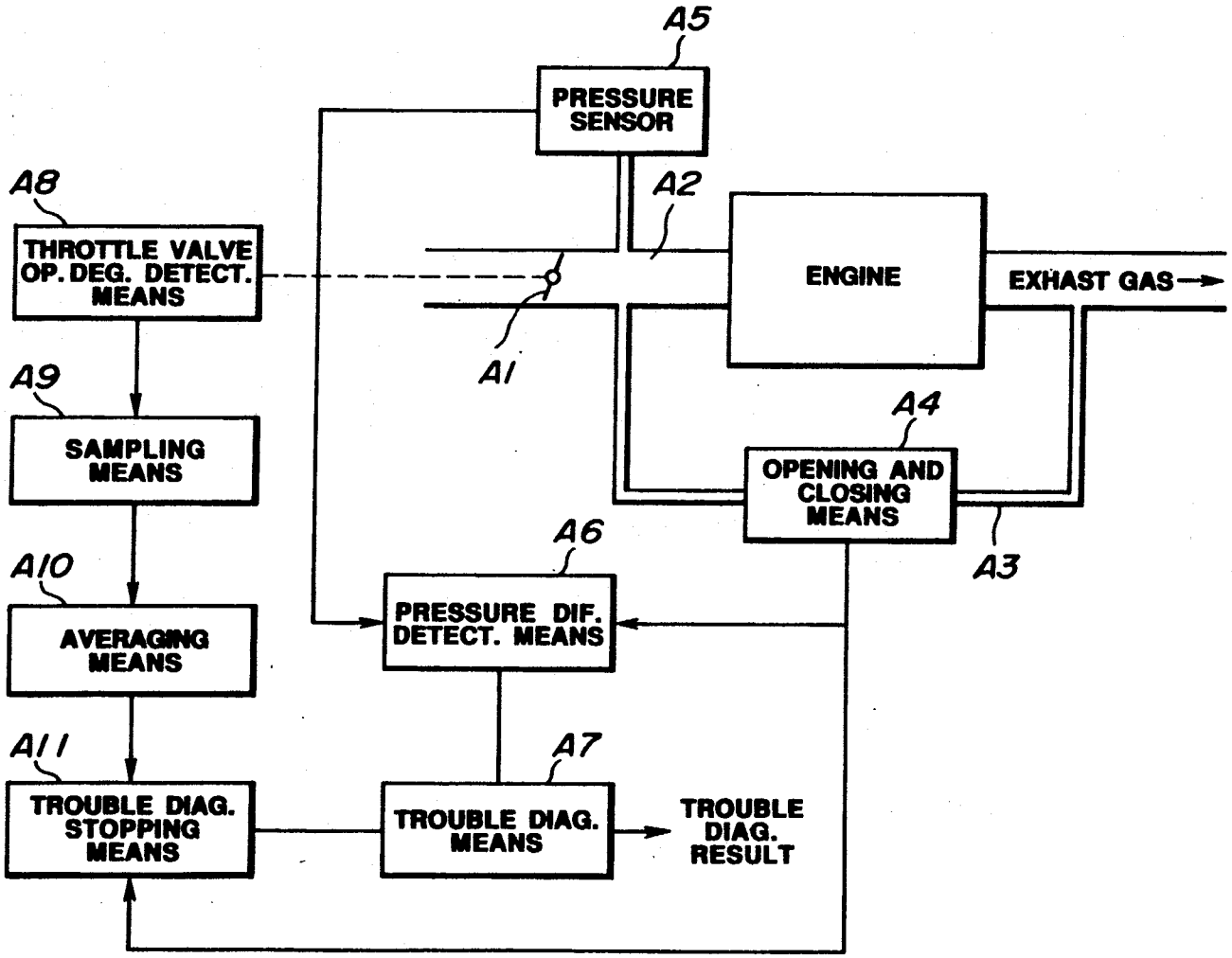
FIG. 5 is a block diagram showing the principle of the embodiment of FIG. 1.

The principle of the above discussed embodiment will be summarized with reference to FIG. 5.

The trouble diagnosis device of the embodiment is for an exhaust gas recirculation system including an EGR passage through which a part of exhaust gas is fed to an intake air passageway A2 of an engine downstream of a throttle valve A1, and an opening and closing device A4 by which the EGR passage is closable to stop flow of exhaust gas in the EGR passage and openable to allow exhaust gas to flow through the EGR passage. The trouble diagnosis device is comprised of a pressure sensor A5 for detecting an intake pressure within the intake air passageway. A pressure difference detecting means A6 is provide to detect a difference between the intake pressure in a first time in which the EGR passage is opened and the intake pressure in a second time in which the EGR passage is closed. A trouble diagnosis means A7 is provided to accomplish a trouble diagnosis in the exhaust gas recirculation system in accordance with the difference in pressure. A throttle valve opening degree detecting means A8 is provided to detect a throttle valve opening degree of the throttle valve to produce an output representative of the throttle valve opening degree. A sampling means A9 is provided to sample the output of the throttle valve opening degree detecting means with lapse of time to obtain sampled values. An averaging mean A10 is provided to give moving average of the sampled values to obtain averaged values. Additionally, a trouble diagnosis stopping means A11 is provided to stop the trouble diagnosis in accordance with a fluctuation amount of the averaged values in a time during execution of the trouble diagnosis.

While the judgement for stopping the trouble diagnosis has been described as being accomplished in accordance with the fluctuation amount of the weighted mean value ATVOi of the throttle valve opening degree, it will be understood that the judgement may be accomplished as follows in order to improve the accuracy of thereof:

In the above embodiment, the intake vacuum P within the intake manifold 12*a* is estimated by the fluctuation amount of the throttle valve opening degree. However, strictly speaking, the intake vacuum P varies in accordance with an opening area Ai of the throttle valve 13 as given by the following formula:

$$P \propto \frac{Ai}{N \cdot Vc} \quad (3)$$

where N is the engine speed; and Vc is the displacement of the engine. It will be understood that the above throttle valve opening area Ai is given by the throttle valve opening degree TVOi. The weighted mean value JAi of the throttle valve opening area Ai is calculated by the following equation:

$$JAi = X \cdot Ai + (1 - X) \cdot JAi - 1 \quad (4)$$

where X is a weighting factor within a range of $0 < X < 1$; and JAi is the current weighted mean value of the throttle valve opening area Ai; and JAi−1 is is the weighted mean value of the throttle opening area Ai at a prior time, such as the immediately preceding computer computation cycle. A judgement is made as to whether the trouble diagnosis is to be stopped or not in accordance with the fluctuation or variation amount of the weighted mean value JAi during stopping of the exhaust gas recirculation, thus improving the accuracy of the judgement.

Furthermore, in order to further improve the accuracy of the judgement as to whether the trouble diagnosis is to be made or not, the following operation may be carried out:

The weighted mean value JABNi of a value ABNi (=Ai/Ni) obtained by dividing the throttle valve opening area Ai of the throttle valve 13 by an engine speed Ni is calcuated by the following equation:

$$JABNi = Y \cdot ABNi + (1 - Y) \cdot JABNi - 1 \quad (5)$$

where Y is a weighting factor within a range of $0 < Y < 1$; and JABNi is the current weighted means value of the value ABNi; and JABNi−1 is the weighted means value of the value ABNi at a prior time, such as the immediately preceding computer computation cycle. A judgement as to whether the trouble diagnosis is to be made or not is carried out in accordance with the fluctuation or variation amount of the weighted means value JABNi, thereby further improving the accuracy of the judgement.

Figure 6:
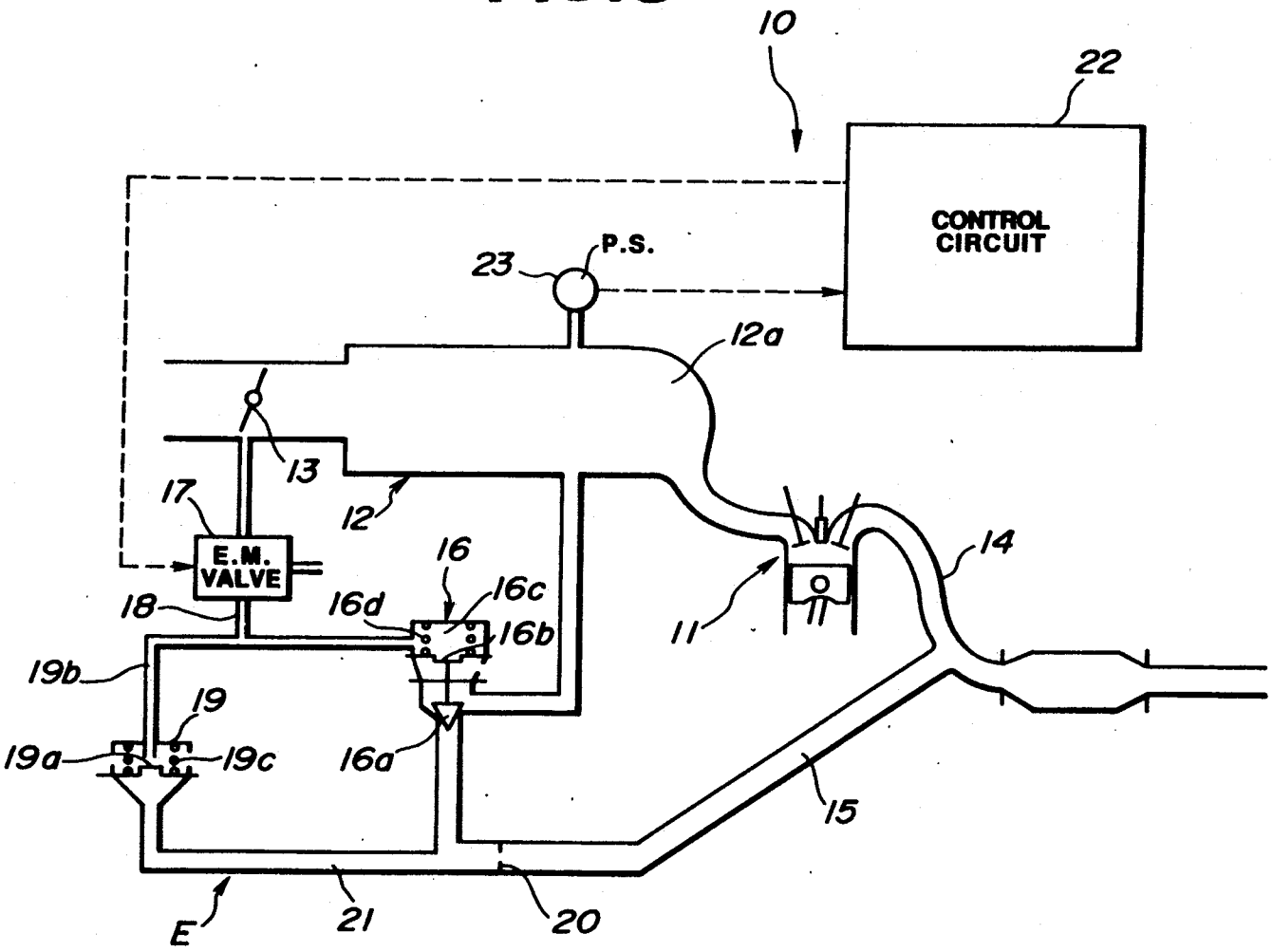
FIG. 6 is a schematic illustration of another embodiment of the trouble diagnosis device in accordance with the present invention.

FIG. 6 illustrates another embodiment of the trouble diagnosis device of the present invention, which is similar to the embodiment of FIG. 1. In this embodiment, the pressure sensor 23 is adapted to detect an absolute pressure P and produce an output or signal representative of the pressure P to the control circuit 22.

The manner of operation of the trouble diagnosis device 10 of this embodiment will be discussed mainly with reference to a flowchart in FIG. 7. The operation of the flow of the flowchart is carried out by causing the electromagentic valve 17 to be periodically energized or turned ON for a predetermined time to temporarily stop the exhaust gas recirculation in an EGR operating range in which the exhaust gas recirculation is carried out.

Figure 7:
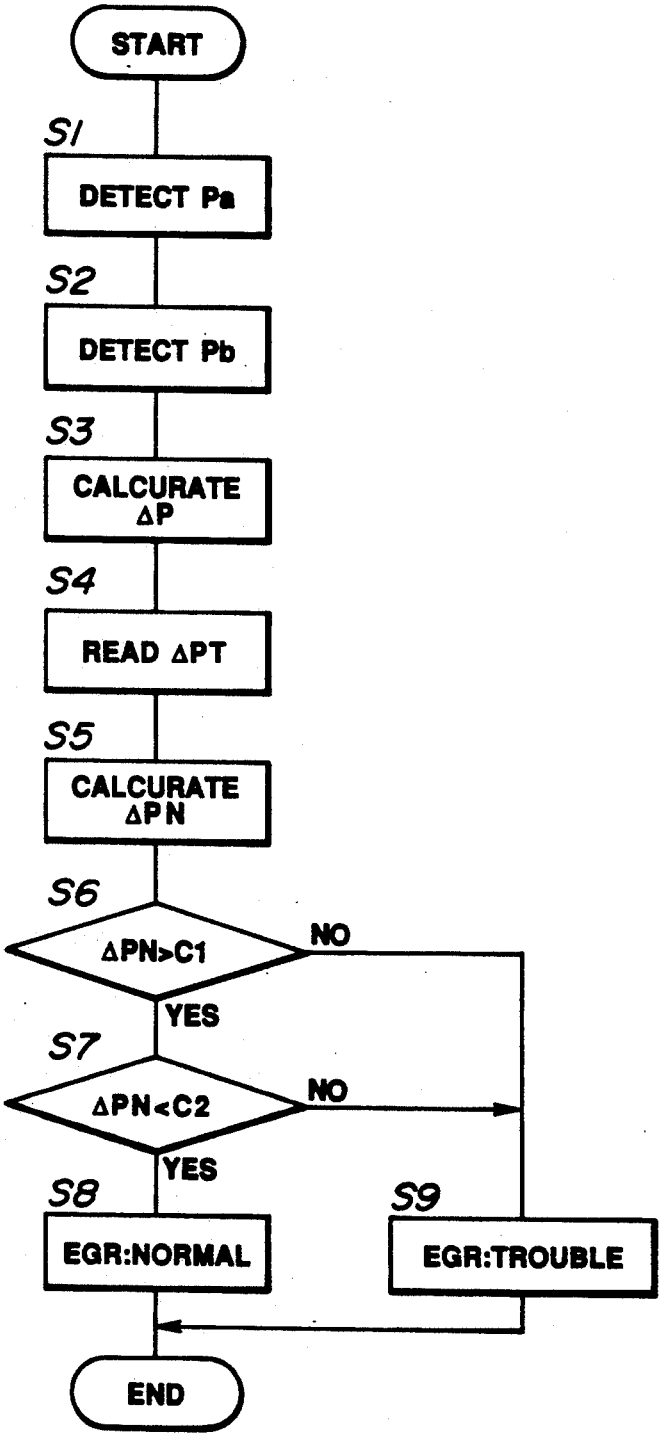
FIG. 7 is a flowchart showing an operation of the trouble diagnosis device of FIG. 6.
Figure 8:
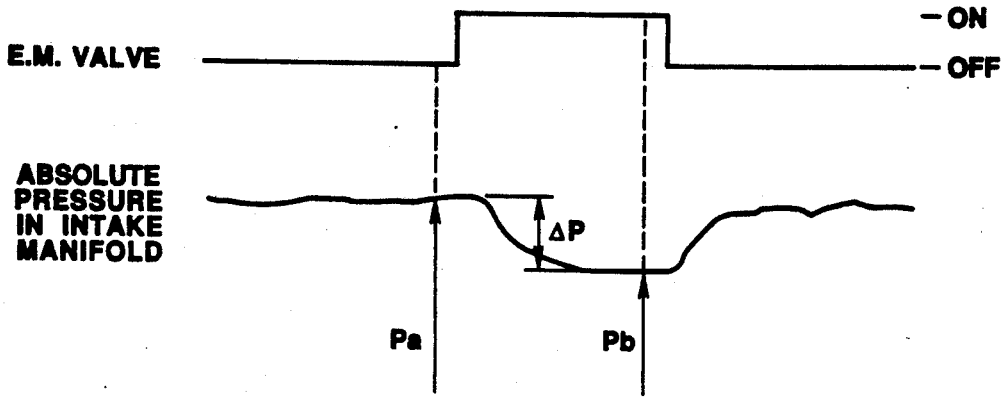
FIG. 8 is a time chart showing the relationship between the operation of an electromagnetic valve and an absolute pressure in an intake manifold, in the operation of the flowchart of FIG. 7.

First, immediately before the electromagnetic valve 17 is energized or turned ON, i.e., immediately before the exhaust gas recirculation is stopped, the output of the pressure sensor 23 is fed to the control circuit 22 thereby to detect a pressure (exhaust gas recirculation time pressure) Pa within the intake manifold 12 in a time in which the exhaust gas recirculation is executed, at a step S1 in FIG. 7. Subsequently, immediately before the electromagnetic valve 17 is deenergized or turned OFF after energized, i.e., before the exhaust gas recirculation is reopened, the output of the pressure sensor 23 is fed to the control circuit 22 thereby detecting a pressure (exhaust gas recirculation stopping time pressure) Pb within the intake manifold 12, at a step S2. The operations in the steps S1 and S2 are represented as a time chart in FIG. 8 in which the EGR control valve 16 is opened and closed respectively when the electromagnetic valve 17 is deenergized and energized. In this connection, it is preferable the time duration in which the electromagnetic valve 17 is energized to stop the exhaust gas recirculation is as short as possible, in which a predetermined time duration at which the pressure is stable is set after the absolute pressure P lowers, as indicated in FIG. 8.

Then, a pressure diffence ΔP between the exhaust gas recirculation time pressure Pa and the exhaust gas recirculation time pressure Pb is calculated at a step S3. Here, the inventors' experiments have revealed that the pressure difference ΔP varies as the exhaust gas recirculation time pressure Pa changes, as shown in FIG. 5 in which the pressure Pa is represented as a relative pressure difference (mercury column gauge pressure) to atmospheric pressure. In other words, the pressure difference ΔP is approximately proportional to the exhaust gas recirculation time pressure Pa. It is to be noted that when the difference between the exhaust gas pressure and the exhaust gas recirculation pressure Pa is relatively small, the flow speed of the exhaust gas recirculated cannot reach the sonic velocity, so that the pressure difference ΔP is kept at an approximately constant value.

Figure 10:
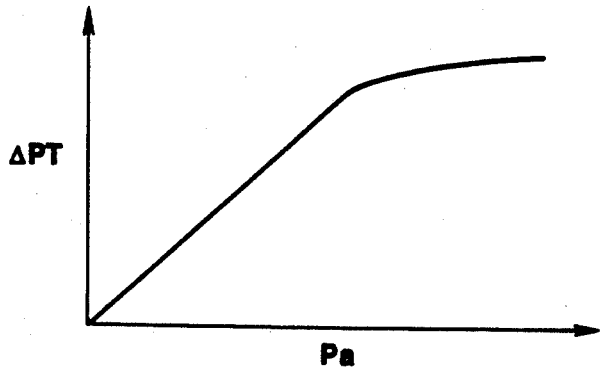
FIG. 10 is a graph showing the relationship between the absolute pressure Pa and a pressure difference ΔPT in a time in which exhaust gas recirculation is normally carried out, employed in the operation of the flowchart of FIG. 7.

In connection with the above, the pressure difference ΔP relative to the exhaust gas recirculation pressure Pa within the intake manifold pressure 12 has been previously measured when the exhaust gas recirculation is normally carried out. The measured data are memorized as a pressure difference ΔPT (in a time in which the exhaust gas recirculation is normally carried out) in a memory in the control circuit 22. The pressure difference ΔPT is given relative to the exhaust gas recirculation time pressure Pa so as to have a characteristics, for example, as shown in FIG. 10.

Figure 9:
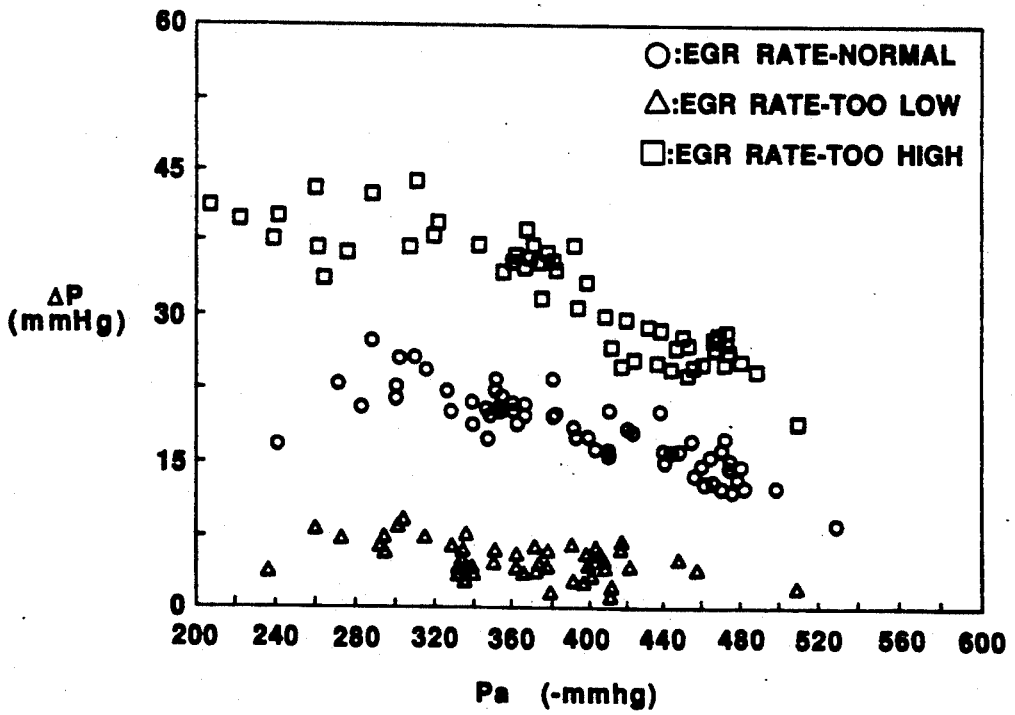
FIG. 9 is a graph of experimental data showing a variation of a pressure difference ΔP in terms of an absolute pressure Pa in the intake manifold, illustrating the effect of the embodiment of FIG. 6.
Figure 11:
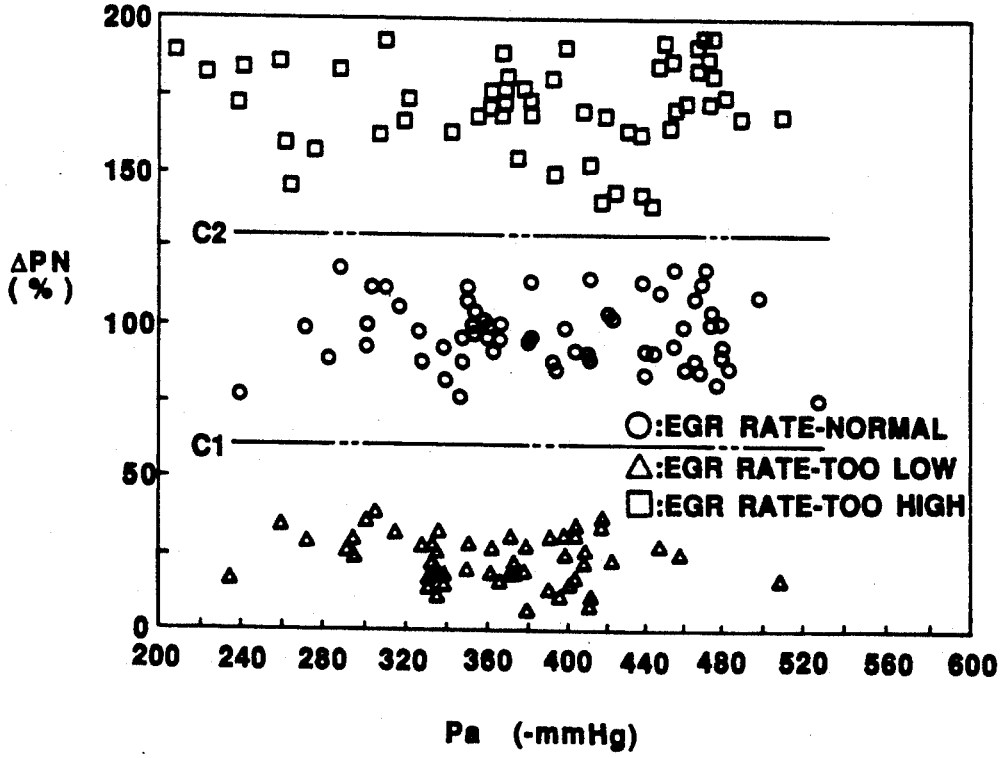
FIG. 11 is a graph of experimental data showing a variation of a value ΔPN in terms of the absolute pressure Pa in the intake manifold, illustrating the effect of the embodiment of FIG. 6.

At a step S4, the pressure difference ΔPT is read relative to the exhaust gas recirculation time pressure Pa detected at the step S1. Then, the pressure difference ΔP is divided by the pressure difference ΔPT thereby to obtain a value ΔPN(=ΔP/ΔPT) at a step S5. It will be understood that ΔP and ΔPN are the values at the same pressure Pa. By this operation, the influence of the exhaust gas recirculation time pressure Pa to the pressure difference ΔP is removed. According to the inventors' experiments, it has been confirmed that in case of a relationship of FIG. 9 between the pressure Pa and the pressure difference ΔP, the value ΔPN is maintained approximately constant even if the pressure Pa varies, as shown in FIG. 11. It will be understood that the value ΔPN may be given by dividing the pressure difference ΔP by the recirculation time pressure Pa (i.e., ΔPN=ΔP/Pa), thereby providing the approximately same result as that in the above discussed operation.

Subsequently, a judgement is made as to whether the value ΔPN is within a range between a lower limit C1 and a higher limit C2 (See FIG. 11) or not at steps S6 and S7, thereby deciding as to whether the exhaust gas recirculation is normally carried out or not. In other words, the EGR system E is judged to normally operate when the value ΔPN is within the range between the lower limit value C1 and the upper limit value C2 at a step S8. On the contrary, the EGR system E is judged to be in trouble when the value ΔPN is out of the range, at a step S9.

As discussed above, according to this embodiment, first the absolute pressures Pa and Pb within the intake manifold 12 are detected respectively at the exhaust gas recirculation time and the exhaust gas recirculation stopping time. Then, the pressure difference ΔP between the absolute pressures Pa and Pb is corrected in accordance with the absolute pressure Pa within the intake manifold 12 to obtain the corrected value ΔPN which is a value from which the influence of the exhaust gas recirculation time pressure Pa is removed. Finally, the trouble diagnosis for the EGR system E is accomplished upon judgement as to whether the value ΔPN is within a predetermined range or not. Accordingly, even when a pressure change is made in the intake manifold 12 owing to an opening degree change of the throttle valve, a precise trouble diagnosis can be achieved. Additionally, according to this embodiment, it can be possible to judge that a trouble arises in the EGR system E when the exhaust gas recirculation (EGR) rate becomes out of the predetermined range as shown in FIG. 11.

Figure 12:
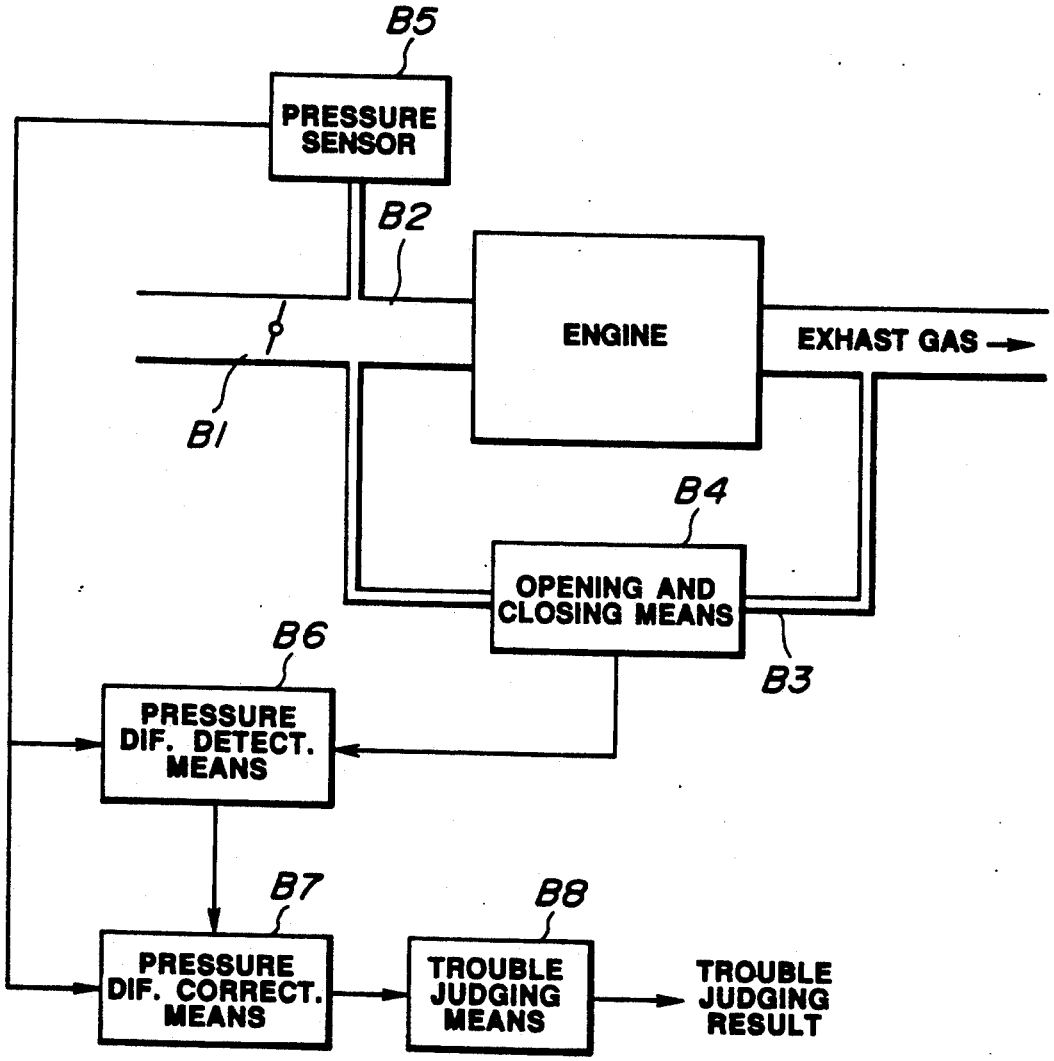
FIG. 12 is a block diagram showing the principle of the embodiment of FIG. 6.

The principle of this embodiment will be summarized with reference to FIG. 12.

The trouble diagnosis device of this embodiment is for an exhaust gas recirculation system including an EGR passage B3 through which a part of exhaust gas is fed to an intake air passageway B2 of an engine downstream of a throttle valve B1, and means B4 by which the EGR passage is closable to stop flow of exhaust gas therethrough and openable to allow exhaust gas to flow therethrough. The trouble diagnosis device is comprised of a pressure sensor B5 for detecting an intake pressure within the intake air passageway. A pressure difference detecting means B6 is provided to detect a difference between the intake pressure in a first time in which the EGR passage is opened and the intake pressure in a second time in which the EGR passage is closed. A pressure difference correcting means B7 is provided to correct the difference in the intake pressure in accordance with the intake pressure in the first time to obtain a corrected pressure difference. Additionally, a trouble judging means B8 is provided to judge an occurrence of trouble in the exhaust gas recirculation system in accordance with the corrected pressure difference.

While the trouble diagnosis operation has been shown and described as being carried out in accordance with absolute pressure in the intake manifold 12 in the embodiment of FIG. 6, it will be understood that it may be carried out in accordance with a gauge pressure (intake vacuum). Additionally, it will be appreciated that the principle of the embodiment of FIG. 6 is applicable to a variety of EGR systems other than the BPT type EGR system.

What is claimed is:

1. A trouble diagnosis device for an exhaust gas recirculation system including an EGR passage through which a part of exhaust gas is fed to an intake air passageway of an engine downstream of a throttle valve, and means by which the EGR passage is closable to stop flow of exhaust gas therethrough and openable to allow exhaust gas to flow therethrough, said trouble diagnosis device comprising:

means for detecting an intake pressure within the intake passageway;

means for detecting a difference between said intake pressure in a first time in which said EGR passage is opened and said intake pressure in a second time in which said EGR passage is closed, a trouble diagnosis in the exhaust gas recirculation system being accomplished in accordance with said difference; and means for raising an accuracy of the trouble diagnosis in the EGR system in accordance with an engine operating parameter.

2. A trouble diagnosis device for an exhaust gas recirculation system including an EGR passage through which a part of exhaust gas is fed to an intake air passageway of an engine downstream of a throttle valve, and means by which the EGR passage is closable to stop flow of exhaust gas therethrough and openable to allow exhaust gas to flow therethrough, said trouble diagnosis device comprising:

means for detecting an intake pressure within the intake air passageway;

means for detecting a difference between said intake pressure in a first time in which said EGR passage is opened and said intake pressure in a second time in which said EGR passage is closed, a trouble diagnosis in the exhaust gas recirculation system being accomplished in accordance with said difference;

means for detecting a throttle valve opening degree of the throttle valve to produce an output representative of said throttle valve opening degree;

means for sampling said output of said throttle valve opening degree detecting means with lapse of time to obtain sampled values;

means for providing moving average of said sampled values to obtain averaged values; and means for detecting a fluctuation amount of said averaged values in a time during the trouble diagnosis, the trouble diagnosis being stopped in accordance with said fluctuation amount.

3. A trouble diagnosis device as claimed in claim 2, wherein said sampling means forms part of a computer, wherein said sampling means is adapted to sample said output of said throttle valve opening degree at a predetermined operation cycle of said computer.

4. A trouble diagnosis device as claimed in claim 3, wherein said predetermined operation cycle is a predetermined computation cycle of said computer.

5. A trouble diagnosis device as claimed in claim 2, wherein said fluctuation amount detecting means includes means for detecting a first averaged value in said first time and immediately before said second time, and a second averaged value in said second time, and means for detecting a difference between said first and second averaged values, higher than a predetermined value.

6. A trouble diagnosis device as claimed in claim 5, further comprising means for stopping the trouble diagnosis when said difference in averaged value exceeds a predetermined value.

7. A trouble diagnosis device as claimed in claim 2, further comprising means for accomplishing said trouble diagnosis in accordance with said difference in intake vacuum.

8. A trouble diagnosis device as claimed in claim 2, wherein said intake pressure detecting means is adapted to detect said intake pressure in said intake air passage downstream of said throttle valve.

9. A trouble diagnosis device for an exhaust gas recirculation system including an EGR passage through which a part of exhaust gas is fed to an intake air passageway of an engine downstream of a throttle valve, and means by which the EGR passage is closable to stop flow of exhaust gas therethrough and openable to allow exhaust gas to flow therethrough, said trouble diagnosis device comprising:

means for detecting an intake pressure within the intake air passageway;

means for detecting a first difference between said intake pressure in a first time in which said EGR passage is opened and said intake pressure in a second time in which said EGR passage is closed;

means for correcting said first difference in said intake pressure in accordance with said intake pressure in said first time to obtain a corrected pressure difference; and means for judging an occurrence of trouble in the exhaust gas recirculation system in accordance with said corrected pressure difference.

10. A trouble diagnosis device as claimed in claim 9, wherein said judging means includes means for judging the trouble in accordance with said corrected pressure difference out of a predetermined range.

11. A trouble diagnosis device as claimed in claim 9, wherein intake pressure detecting means is adapted to detect said intake pressure in said intake air passage downstream of the throttle valve.

12. A trouble diagnosis device as claimed in claim 11, wherein said correcting means includes means for detecting said first difference in said intake pressure in a third time in which an exhaust gas recirculation is normally carried out, means for memorizing said difference relative to said intake pressure in said first time to obtain a second difference in said intake pressure, and means for dividing said first difference in said intake pressure by said second difference in said intake pressure to obtain said corrected pressure difference.

13. A trouble diagnosis device as claimed in claim 12, wherein said first difference detecting means includes means for detecting a plurality of said first differences in said intake pressure in said third time, and said memorizing means includes means for memorizing said plurality of said first differences relative to a plurality of said intake pressure in said first time.

14. A trouble diagnosis device as claimed in claim 13, wherein said dividing means includes means for dividing said first difference by said second difference, said first and second differences being the same in said intake pressure in said first time.

* * * * *